US007097416B2

(12) United States Patent
Gurth

(10) Patent No.: US 7,097,416 B2
(45) Date of Patent: Aug. 29, 2006

(54) ROTARY DISC PUMP

(75) Inventor: Max I. Gurth, El Cajon, CA (US)

(73) Assignee: Discflo Corporation, El Cajon, CA (US)

( * ) Notice: Subject to any disclaimer, the term of this patent is extended or adjusted under 35 U.S.C. 154(b) by 0 days.

(21) Appl. No.: 10/669,566

(22) Filed: Sep. 25, 2003

(65) Prior Publication Data

US 2005/0069409 A1 Mar. 31, 2005

(51) Int. Cl.
*F04D 1/04* (2006.01)

(52) U.S. Cl. ..... 415/71; 415/90; 415/175; 415/176

(58) Field of Classification Search ..... 415/90, 415/72; 416/175, 176, 198 R, 203
See application file for complete search history.

(56) References Cited

U.S. PATENT DOCUMENTS 2,087,834 A * 7/1937 Brown et al. ..... 244/62
2,505,125 A * 4/1950 List ..... 366/80
2,632,598 A * 3/1953 Wales, Jr. ..... 416/4
4,634,344 A * 1/1987 Zagar et al. ..... 416/175
5,165,846 A * 11/1992 Possell ..... 415/90
5,192,182 A * 3/1993 Possell ..... 415/90

* cited by examiner

*Primary Examiner*—Edward K. Look
*Assistant Examiner*—Devin Hanan
(74) *Attorney, Agent, or Firm*—Gordon & Rees LLP

(57) ABSTRACT

A rotary disc pump for pumping fluid materials, comprises a housing having a front and a back wall forming a chamber with a generally coaxial inlet in the front wall and a generally tangential outlet, an impeller is mounted co-axially within the chamber and comprises a shaft mounted in the back wall of said housing and having an outer end extending from the housing and an inner end within the chamber, at least a first circular which is disc mounted on the inner end of the shaft, and at least a second disc which is mounted in axially spaced relation to the first disc and has an opening in the center thereof, arid a conical member which extends co-axially of the shaft from the first disc toward the second disc.

17 Claims, 8 Drawing Sheets

ROTARY DISC PUMP

BACKGROUND OF THE INVENTION

The present invention relates generally to fluid pumps and pertains particularly to an improved rotary disc pump.

Rotary disc pumps have been generally known for a considerable length of time but little used until recent years. The rotary disc pump utilizes an impeller having a plurality of generally planar discs having an open center mounted on and spaced axially along a rotary shaft. The rotating discs utilize surface drag or boundary layer friction of the planar surfaces of the discs to propel a fluid through the pump. In the past such disc pumps have been unable to compete effectively with positive displacement pumps and bladed impeller pumps for the pumping of fluids for most applications.

The applicant has in recent years, developed improvements in disc pumps that made them commercially practical for the pumping wide variety of liquids and materials in liquids including slurries and the like. As a result of these improvements, rotary disc pumps have come into widespread use in many applications where traditional positive displacement pumps and bladed impeller pumps are not practical. While disc pumps will not replace positive displacement pumps and bladed impeller pumps in most applications, they have begun to replace them in many applications where such positive displacement and bladed impeller pumps are unsuitable.

The suitable applications for disc pumps include highly viscous materials and fluids containing solids, both hard and delicate. These applications occur particularly in the food and pharmaceutical industries, where there are many delicate and fragile shear and impact sensitive materials that can be easily damaged with positive displacement pumps and bladed impeller pumps. For this reason these materials cannot be satisfactorily pumped or transported with these pumps. The moving blade of impeller pumps can impact and bruise or otherwise cause damage to delicate and fragile materials.

The disc pump has begun to be widely used in the food processing and pharmaceutical industries for many applications including the pumping of liquids. In the pumping of many liquids, particularly in these industries, it is important that the inclusion of gas or air in the liquid be minimized. The present invention has been discovered to greatly reduce and in many instances eliminate generation or inclusion of air bubbles and the like in such liquids.

Accordingly there is a need for an improved pump for the pumping of delicate shear and impact sensitive materials that reduces entrapped air and gasses.

It is therefore desirable to have an improved pump for handling of delicate and other difficult to pump materials.

SUMMARY OF THE INVENTION

It is therefore a primary object of the present invention to provide an improved pump for pumping of delicate, sensitive and flow resistant materials.

It is another object of the present invention to provide an improved pump for pumping of delicate and sensitive liquids with minimum entrapped air and gasses.

In accordance with a primary aspect of the present invention, a rotary disc fluid pump for pumping fluid materials, comprises a housing having a front and a back wall forming a chamber with a generally coaxial inlet in the front wall and a generally tangential outlet, an impeller mounted co-axially within the chamber and comprising a shaft mounted in the back wall of said housing and having an outer end extending from the housing and an inner end within the chamber, at least a first circular disc mounted on the inner end of the shaft, at least a second disc mounted in axially spaced relation to the first disc and having an opening in the center thereof, and a converging member extending coaxially of the shaft from the first disc converging toward a point least one half the distance to the inlet.

BRIEF DESCRIPTION OF THE DRAWINGS

The above and other objects and advantages of the present invention will become apparent from the following description when read in conjunction with the accompanying drawings wherein.

DETAILED DESCRIPTION OF THE PREFERRED EMBODIMENTS

The present invention is directed to an improved rotary disc pump having a disc impeller. The impeller is made up of a disc pack mounted on the shaft and acting as an impeller for drawing fluid in through the openings in the outer discs and propelling it outward, thereby creating flowing of the fluid through the housing. Each impeller comprises at least a pair of spaced apart rotary discs, one of which has a central generally unobstructed aperture therethrough for drawing fluid in and the other of which is devoid of an aperture and is connected directly to the shaft. The discs can be planar with planar relatively smooth surfaces or may have small radial vanes or ribs on the opposed planar surfaces as will be discussed. The openings in the discs may be the same diameter so that a different size opening is provided in co-operation with a converging or diverging member extending co-axially of the rotor. Alternatively, the openings may increase with increase in diameter of the converging member to present substantially equal radial openings in co-operation with the diverging member.

Figure 1:
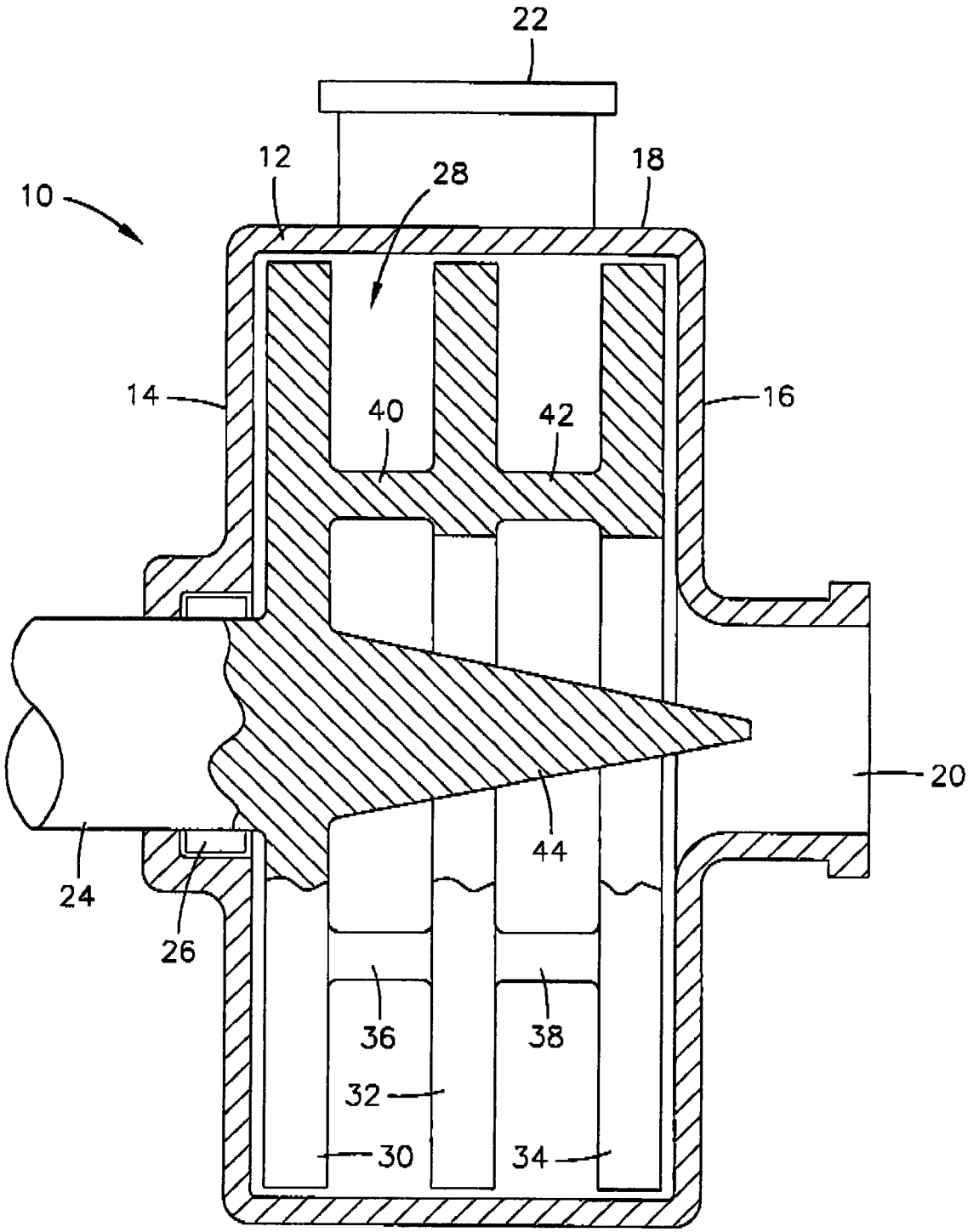
FIG. 1 is a side elevation view partially in section of an exemplary first embodiment of the present invention.

Referring to FIG. 1, an exemplary embodiment of a disc pump in accordance with one embodiment of the invention is illustrated and designated generally by the numeral 10. The apparatus, in accordance with the invention, comprises a rotary disc fluid pump which comprises a main housing 12 having an inner or back side wall 14 and an outer or front side wall 16 joined by a peripheral wall 18 forming a generally cylindrical chamber. An inlet 20 is formed co-axially of the chamber in the outer wall and an outlet 22 is tangential of the peripheral wall 18. An elongated rotary shaft 24 is rotatably mounted in a suitable bearing 26 co-axially in the inner side wall and includes an impeller designated generally at 28 mounted thereon.

The impeller as shown comprises a inner planar circular disc 30 on the inner end of shaft 24 with second disc 32 and a third or outer disc 34. The discs 32 and 34 have openings 36 and 38 defined by inner circular diameters. The second disc is connected by a plurality of pins or studs 40 to the inner disc, and the outer disc is connected by pins or studs 42 to the second disc. The impeller may be made up of any number of discs from one to several dozen. The discs may also have any desired spacing depending on the material to be pumped. A converging member 44 having a generally conical configuration is secured or formed centrally of the drive disc 30 and extends co-axially of the chamber through the openings in discs 32 and 34. This converging member extends at least to the center of the housing toward the inlet and preferably at least to the outermost disc and in some instances to the inlet of the housing. It will be appreciated that while this member converges toward the inlet, it diverges toward the outlet or at least the main disc of the impeller. This diverging aids in the generating of a smooth non-turbulent flow through the pump avoiding or reducing the generation of cavitation and air or gas bubbles.

Figure 2:
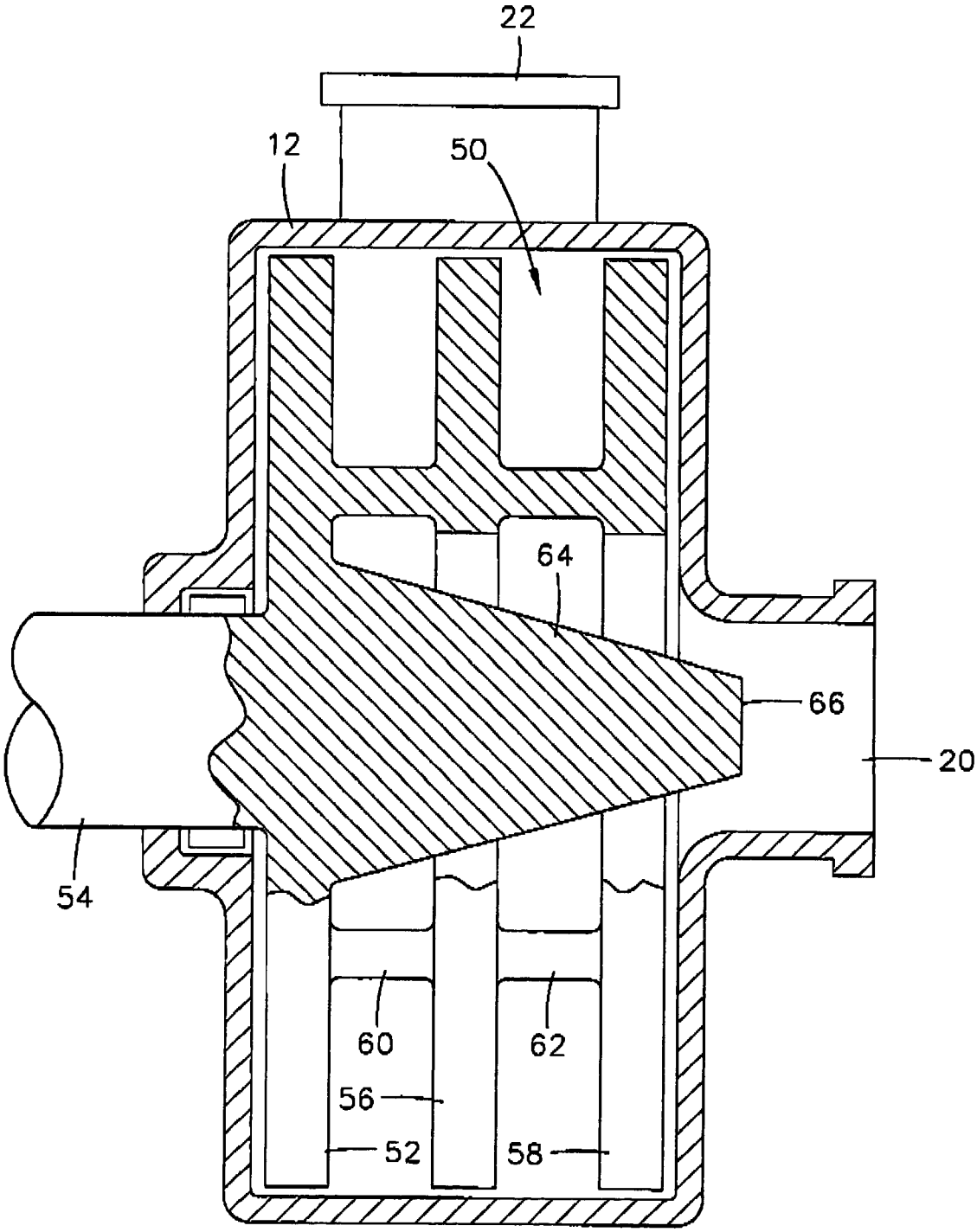
FIG. 2 is a view like FIG. 1 of an alternate embodiment of the present invention.

Referring to FIG. 2, an alternate embodiment is illustrated wherein like numbers identify the same elements. In this embodiment the impeller designated generally at 50 comprises a main disc 52 on the inner end of a shaft 54 with pair of discs 56 and 58 having central openings and connected to disc 52 by a plurality of pins 60. A generally conical converging member 64 is formed or connected to main disc 52 and extends co-axially of the housing and discs and converges or tapers down toward the inlet. The member 64 extends beyond the outer surface of the outer disc 58 and terminates as shown in a substantially blunt end 66. The end 66 may also be rounded or semispherical in configuration. The openings in the discs 56 and 58 are shown to have substantially the same diameter.

Figure 3:
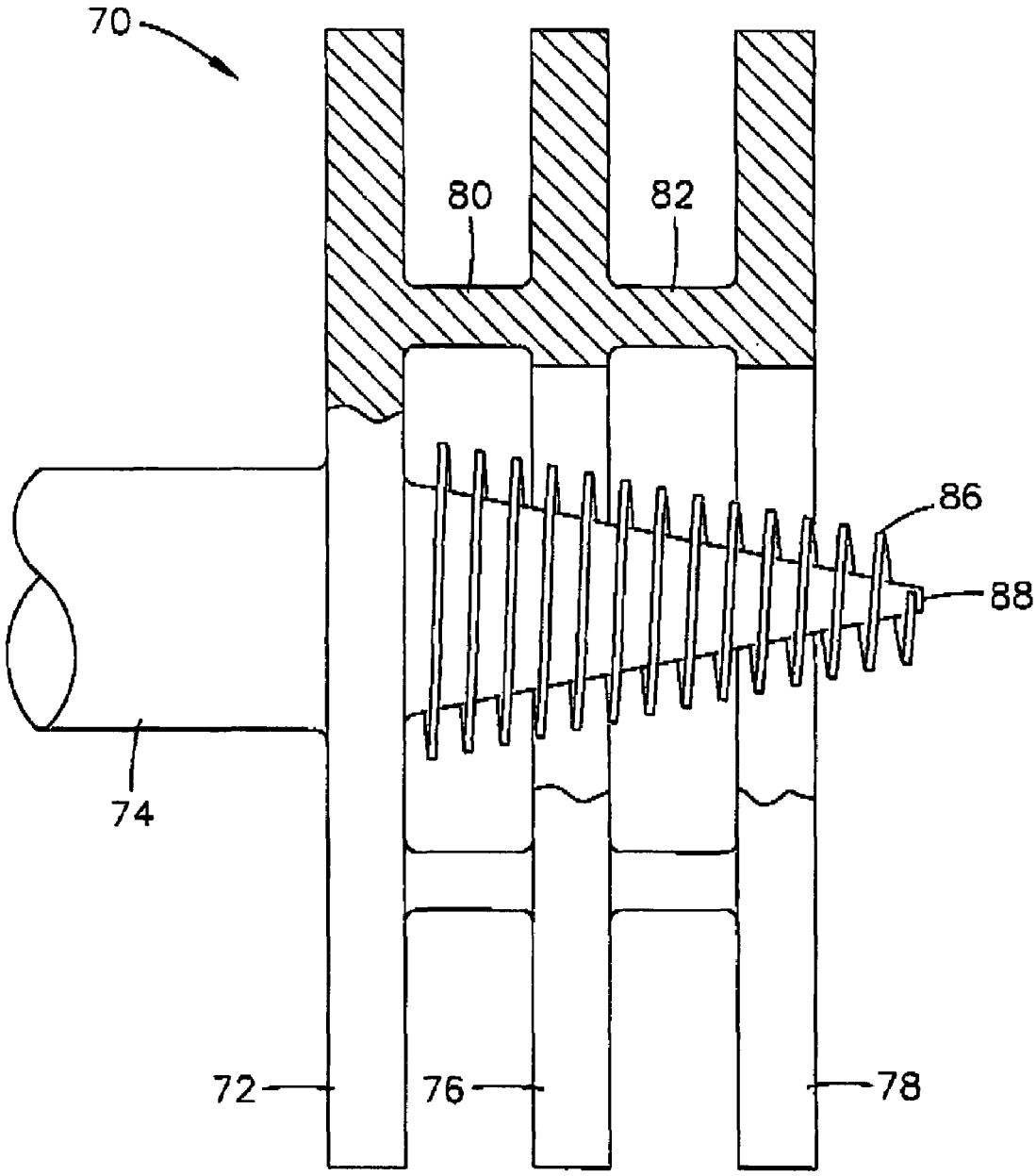
FIG. 3 is a side elevation view partially in section of an alternate embodiment of the disc pack.

Illustrated in FIG. 3 is another embodiment of a rotor designated generally by the numeral 70 which rotor is substantially like rotor 28 of FIG. 1 with a minor modification. In this embodiment the impeller designated generally at 70 comprises a main disc 72 on the inner end of a shaft 74 with a pair of axially spaced discs 76 and 78 having central openings and connected to or supported from disc 72 by a plurality of pins 80 and 82. The pins 80 and 82 are preferably positioned at the inner diameter of the central opening of the discs. A generally conical converging member 84 is formed or connected to main disc 72 and extends co-axially of the housing and discs toward the inlet. The member 84 extends slightly beyond the outer surface of the outer disc 78 and terminates in a substantially pointed end 84. A helical auger-like fin 86 extends along the outer surface of the member 84 from the tip 88 to the main disc 72. This auger structure aids in the pulling of certain materials into the center of the impeller.

Figure 4:
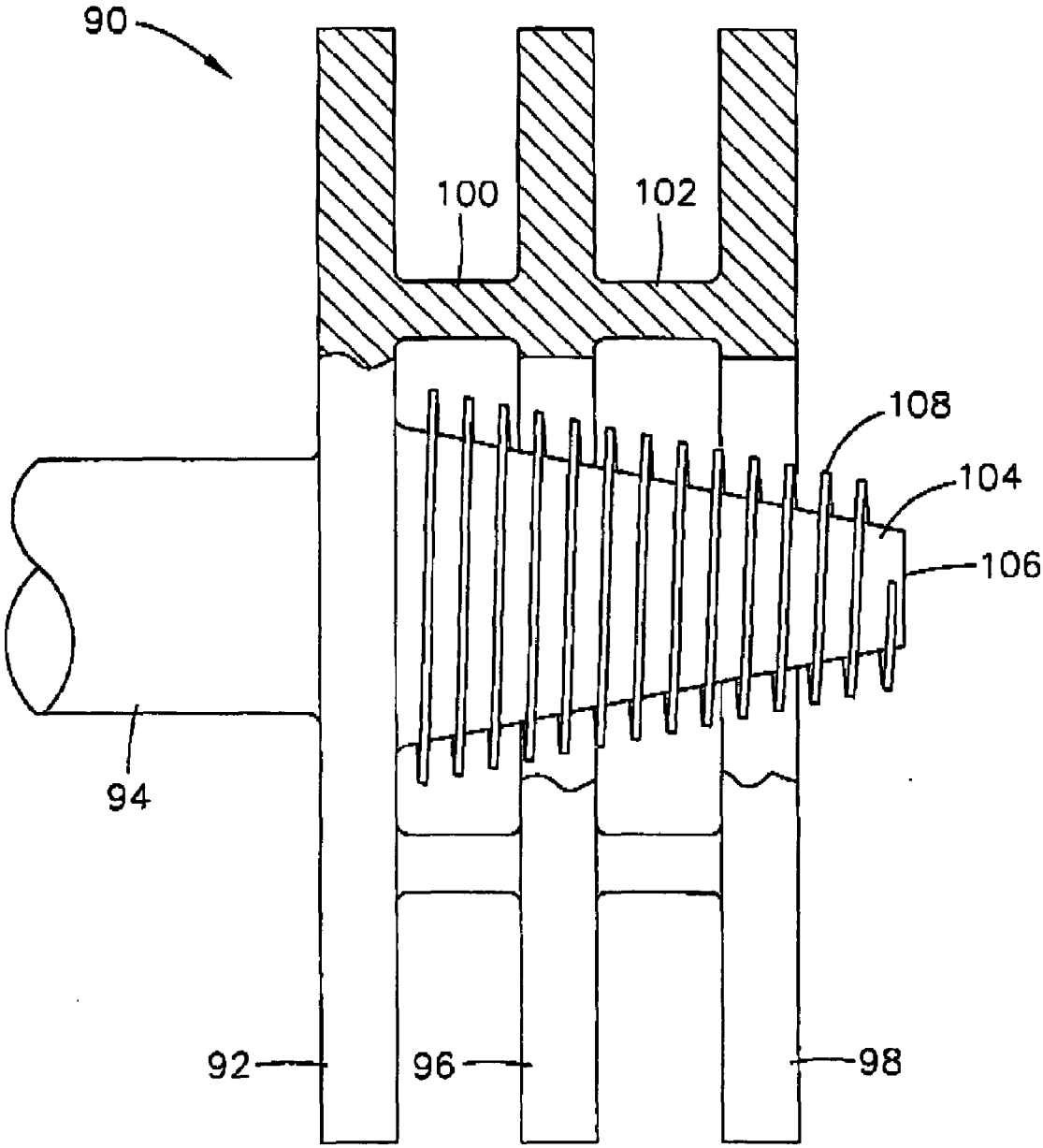
FIG. 4 is a view like FIG. 3 of another embodiment of the present invention.

As shown in FIG. 4, a further embodiment of a rotor is illustrated and designated generally by the numeral 90 which rotor is substantially like rotor 64 of FIG. 2 with a minor modification. In this embodiment the impeller designated generally at 90 comprises a main disc 92 on the inner end of a shaft 94 with pair of discs 96 and 98 having central openings and connected to disc 92 by pins 100 and 102. A generally conical converging member 104 is formed or connected to main disc 92 and extends co-axially of the housing and discs. The member 104 extends slightly beyond the outer surface of the outer disc 98 and terminates in a substantially blunt end 106. A helical auger-like fin 108 extends along the outer surface of the member 104 from the tip 106 to the main disc 92. This auger structure aids in the pulling of certain materials into the center of the impeller.

Figure 5:
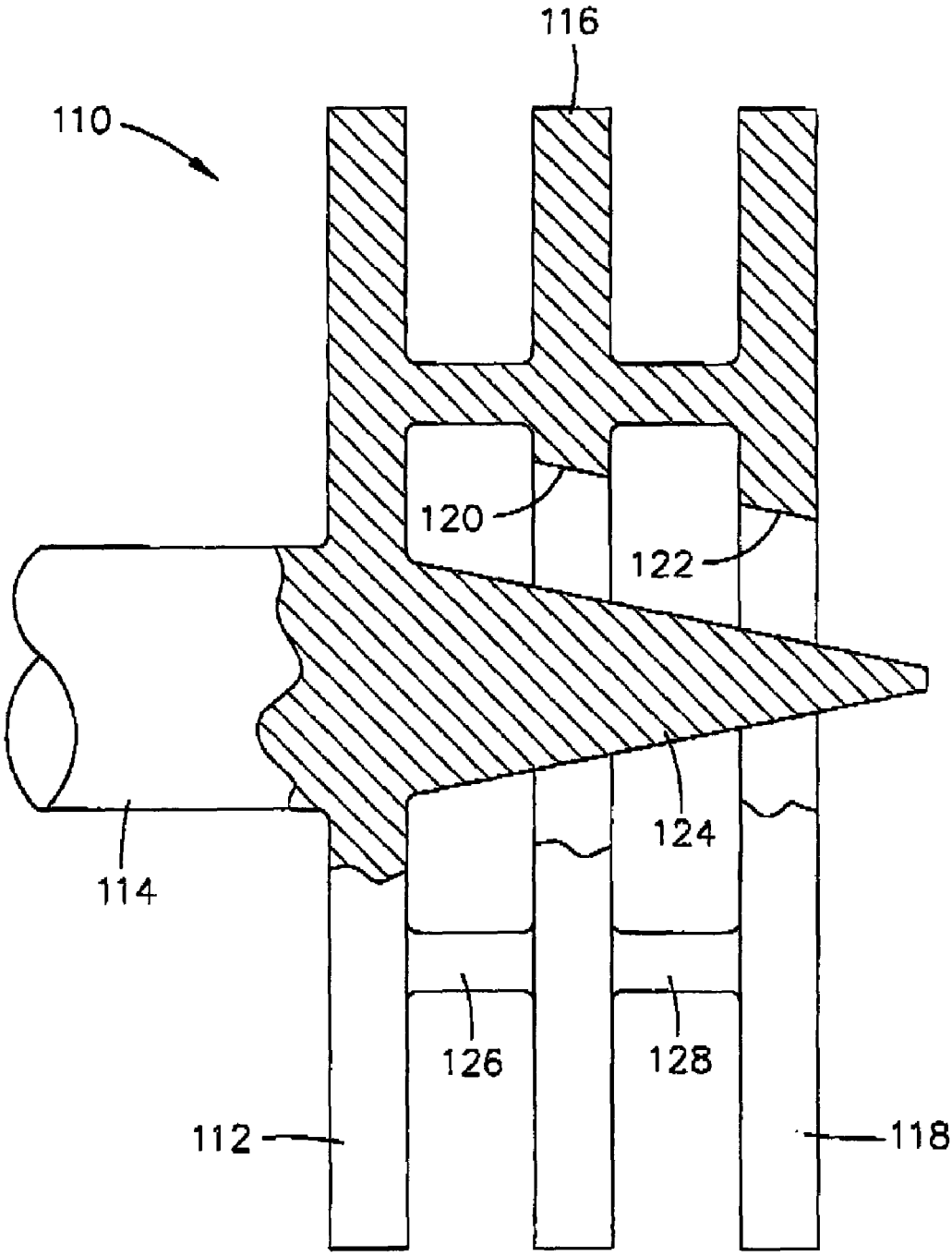
FIG. 5 is a view like FIG. 3 of a further embodiment of the present invention.

Referring to FIG. 5, a still further embodiment is illustrated wherein the impeller designated generally at 110 comprises a main disc 112 on the inner end of a shaft 114 with pair of discs 116 and 118 having central openings 120 and 122. The central openings of the discs are shown to vary in diameter with a converging member 124. The discs 116 and 118 are connected to main disc 112 by a plurality of pins 126 and 128 at the edge of the central openings. A generally conical converging member 124 is formed or connected to main disc 112 and extends co-axially of the housing and discs as in prior embodiments. The inner diameter of the discs forming the central openings vary to provide a constant spacing between the disc inner diameter and the outer surface of the converging member 124. This allows solids of a selected diameter to pass through the pump. For example, a spacing of two inches allows articles of two inch diameter to pass through the pump.

Figure 6:
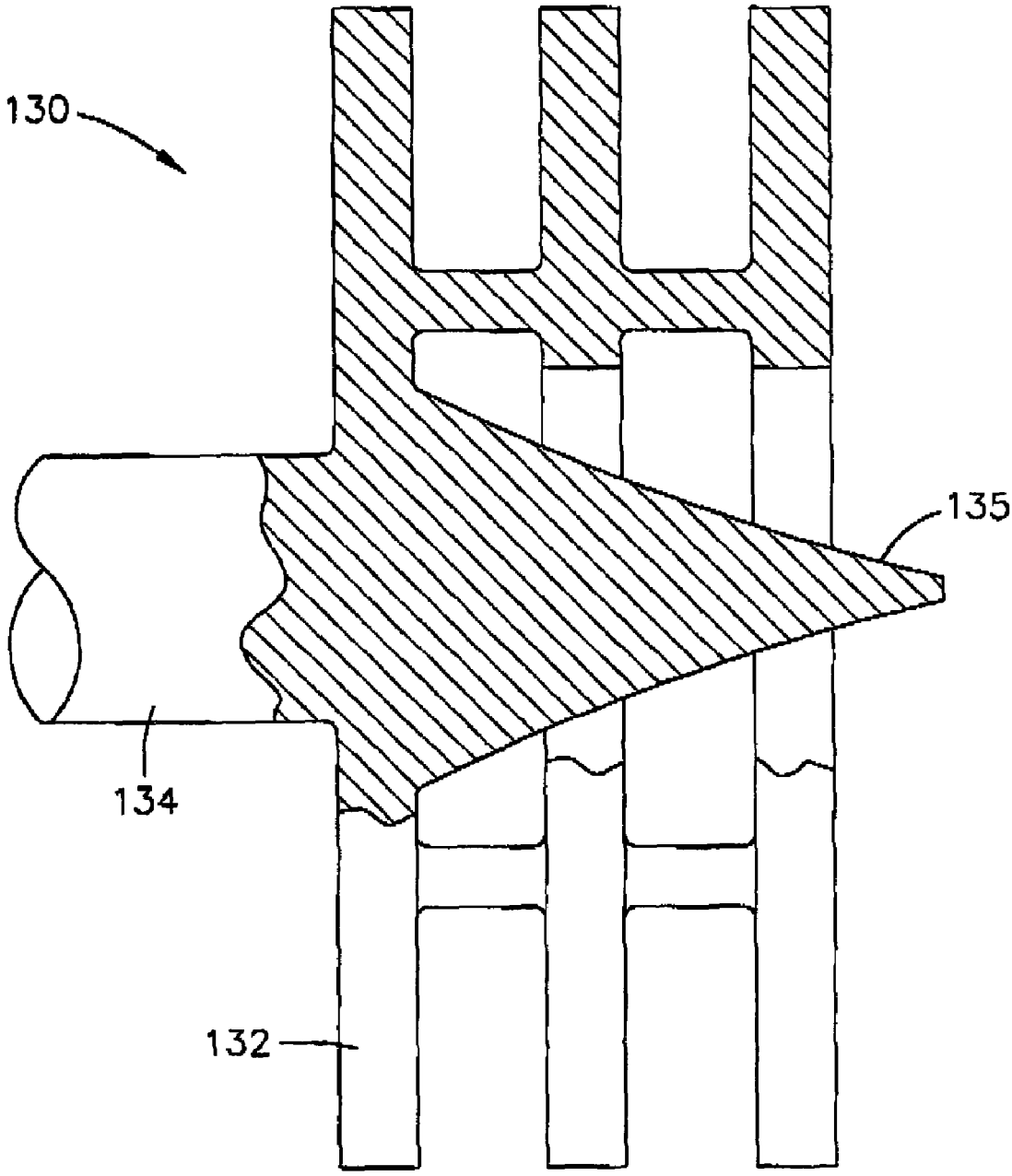
FIG. 6 is a view like FIG. 3 of still another embodiment of the present invention.

FIG. 6 illustrates a still further embodiment wherein the main disc of the impeller illustrated and designated generally at 130 comprises a main disc 132 on the inner end of a shaft 134 with a converging member 135 extending co-axially outward as in prior embodiments. The impeller may have any number of additional discs as shown. The generally conical converging member 134 is formed or connected to main disc 132 and extends co-axially of the housing and other discs as in previous embodiments. The outer surface of the converging member 136 is formed somewhat concave which gives a smoother transition to the surfaces of the discs. This member reduces any tendency the impeller may have for cavitation and to induce air bubbles in the fluid being pumped.

Figure 7:
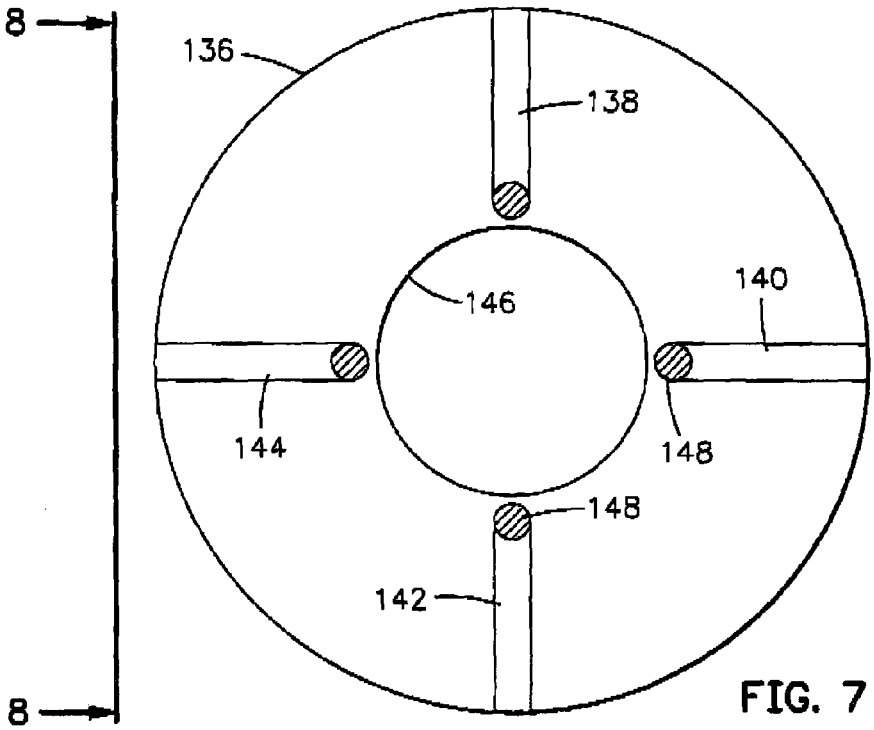
FIG. 7 is a front elevation of an exemplary alternate embodiment of a disc for a disc pack of the present invention.
Figure 8:
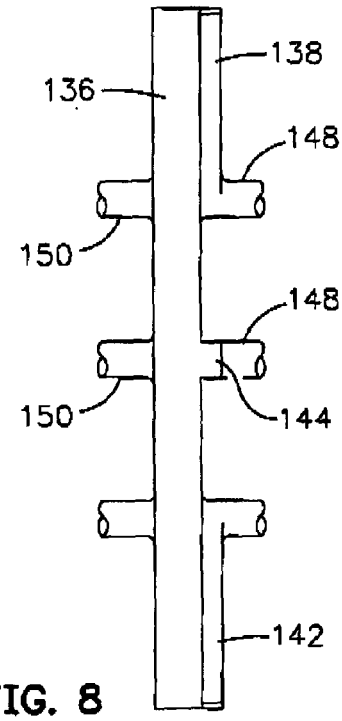
FIG. 8 is a side elevation view of the disc of FIG. 7.

FIGS. 7 and 8 illustrates a modification of the surfaces of the discs of the impeller. A typical disc 136 is illustrated with radial ribs 138, 140, 142 and 144 which extend radially outward from an opening 146 in the center of the disc. These ribs may be on one or both faces of the disc. They may also be straight as shown or curved and aid in increasing the head or pressure of the pump without impacting the material being pumped in most cases. The disc is also formed with pins 148 and 150 connecting it to adjacent discs, (not shown).

Figure 9:
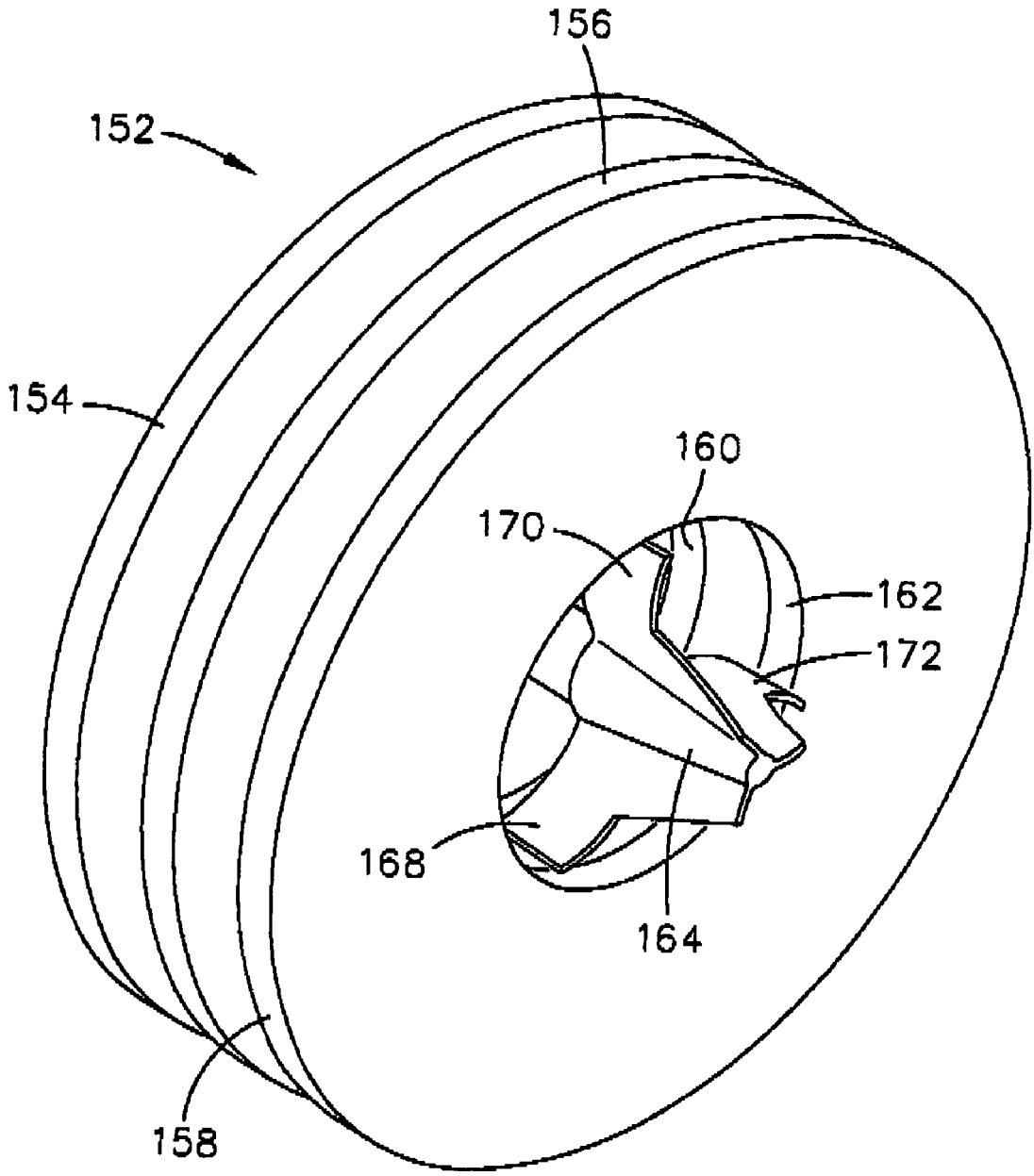
FIG. 9 is a perspective view a still further embodiment of the present invention.

An additional embodiment of the invention is illustrated in FIG. 9 wherein an impeller designated generally at 152 is substantially like rotor 64 of FIG. 2 with a minor modification. In this embodiment the impeller comprises a main disc 154 on the inner end of a shaft (not shown) with a pair of discs 156 and 158 having central openings and connected to disc 154 by pins (not shown). The discs 156 and 158 have an inner diameter 160 and 162 forming central openings as in prior embodiments. A generally conical converging member 164 is formed or connected to the main disc and extends co-axially of the housing and discs. The member 164 extends slightly beyond the outer surface of the outer disc 158 and terminates in a substantially blunt end 166. A plurality of radially extending curved blades 168, 170 and 172 are mounted on the outer surface of the converging member within the central openings of the discs. These aid in directing certain materials outward between the discs during operation.

The discs of the various impellers are preferably connected or secured to and supported by the main disc by means of pins at the inner diameter of the openings of the discs. This positioning allows solid particles and articles to pass through the pump with minimal impact with the pins. These pins may be separate pins or formed integral with the disc pack assembly and are preferably at the innermost diameter of the disc to minimize impact on materials moving through the aperture and space between the discs. The opposing faces of the discs act on the fluid imposing a shear force or drag to propel it radially outward from between the discs.

A preferred way of forming a disc pack assembly, particularly for delicate and fragile solutions or mixtures, is to machine the entire assembly from a casting or from a blank or billet so that the entire unit is a unitary integral unit. This eliminates cracks and joints in the assembly and the problems of interference with flow of particles and the like caused by the sharp edges of bolts, screws and the like. In an alternate form of the disc pack outwardly spiraling ridges may be formed on the opposing faces of the disc to increase the propelling effect of the disc. The ridge can be almost any height but in most cases is preferably on the order of about one to about two times the thickness of the disc.

The discs normally propel the fluid by surface friction of the planar faces thereby applying a centrifugal force to the fluid forcing it outward from the space between the discs. This has an effect of propelling the fluid radially outward from between the discs creating a central void which draws fluid from the vessel into the space between the discs, and continuing to propel the fluid outward.

While I have illustrated and described my invention by means of specific embodiments, it is to be understood that numerous changes and modifications may be made therein without departing from the spirit and scope of the invention, as defined in the appended claims.

I claim:

1. A rotary disc pump for pumping fluid materials, comprising: a housing having a front wall, a back wall and peripheral wall joining said front and back walls forming a chamber with a generally coaxial inlet in said front wall and a generally tangential outlet formed in said peripheral wall; an impeller mounted co-axially within said chamber and comprising a shaft mounted in said back wall of said housing and having an outer end extending from said housing and an inner end within said chamber, at least a first circular disc mounted on the inner end of said shaft, at least a second disc mounted in axially spaced relation to said first disc and having an opening in the center thereof; and a converging member extending co-axially of said shaft from said first disc converging toward a point at least one half the distance to said second disc; and a helical fin formed on an outer surface of said converging member.

2. A rotary disc fluid pump according to claim 1, wherein said converging member has a conical surface and extends at least to an inner surface of said second disc.

3. A rotary disc fluid pump according to claim 1, wherein said converging member extends beyond said second disc.

4. A rotary disc fluid pump according to claim 3, wherein said converging member extends beyond said second disc to at least a third disc.

5. A rotary disc fluid pump according to claim 3, wherein said converging member is a frustum of a cone.

6. A rotary disc fluid pump according to claim 1, wherein said converging member is a conical member.

7. A rotary disc fluid pump according to claim 6, wherein said conical member is a frustum of a cone.

8. A rotary disc fluid pump according to claim 1, wherein said converging member has a generally concave surface and extends at least to an inner surface of said second disc.

9. A rotary disc fluid pump according to claim 1, wherein said converging member has a generally convex surface and extends at least to an inner surface of said second disc.

10. A rotary disc pump for pumping fluid materials, comprising: a housing having a chamber defined by an inner and an outer side wall joined by a generally circular peripheral wall with a generallv coaxial inlet in said outer wall and a generally tangential outlet formed in said circular peripheral wall: an impeller mounted co-axially within said chamber and comprising a shaft mounted in said inner wall of said housing and having an outer end extending from said housing and an inner end within said chamber, at least a first circular disc mounted on the inner end of said shaft, and at least a second disc mounted to said first disc in axially spaced relation to said first disc and having a circular opening in the center thereof, and a conical member having a base at said first disc and extending co-axially of said shaft from said first disc at least half the distance to said second disc; said conical member being formed with a helical fin on an outer surface thereof.

11. A rotary disc fluid pump according to claim 10, wherein said conical member extends at least to an inner surface of said second disc.

12. A rotary disc fluid pump according to claim 10, wherein said conical member extends at least to an outer surface of said second disc.

13. An rotary disc fluid pump according to claim 10, wherein said rotor has an outer disc and said conical member extends at least to an inner surface of said outer disc.

14. An apparatus according to claim 13 wherein said conical member extends at least to an outer surface of said outer disc.

15. An apparatus according to claim 14 wherein said conical member extends beyond an outer surface of said outer disc.

16. An apparatus according to claim 10 wherein said conical member is a frustum of a cone.

17. A rotary disc pump for pumping fluid materials, comprising: a housing having a chamber defined by an inner and an outer side wall joined by a generally circular peripheral wall with a generally coaxial inlet in said outer wall and a generally tangential outlet formed in said circular peripheral wall: an impeller mounted co-axially within said chamber and comprising a shaft mounted in said inner wall of said housing and having an outer end extending from said housing and an inner end within said chamber, at least a first circular disc mounted on the inner end of said shaft, and at least a second disc mounted to said first disc in axially spaced relation to said first disc and having a circular opening in the center thereof, a conical member having a base at said first disc and extending co-axially of said shaft from said first disc at least half the distance to said second disc; said conical member being formed with a plurality of radial blades on an outer surface thereof.

* * * * *

US007097416C1

(12) EX PARTE REEXAMINATION CERTIFICATE (9054th)

United States Patent
Gurth

(10) Number: US 7,097,416 C1
(45) Certificate Issued: Jun. 5, 2012

(54) ROTARY DISC PUMP

(76) Inventor: Max I. Gurth, El Cajon, CA (US)

Reexamination Request:
No. 90/011,646, Apr. 29, 2011

Reexamination Certificate for:

| | |
|---|---|
| Patent No.: | **7,097,416** |
| Issued: | **Aug. 29, 2006** |
| Appl. No.: | **10/669,566** |
| Filed: | **Sep. 25, 2003** |

(51) Int. Cl.
*F04D 1/04* (2006.01)

(52) U.S. Cl. ..... 415/71; 415/90; 415/175; 415/176

(58) Field of Classification Search ..... None
See application file for complete search history.

(56) References Cited

To view the complete listing of prior art documents cited during the proceeding for Reexamination Control Number 90/011,646, please refer to the USPTO's public Patent Application Information Retrieval (PAIR) system under the Display References tab.

*Primary Examiner*—William Doerrler

(57) ABSTRACT

A rotary disc pump for pumping fluid materials, comprises a housing having a front and a back wall forming a chamber with a generally coaxial inlet in the front wall and a generally tangential outlet, an impeller is mounted coaxially within the chamber and comprises a shaft mounted in the back wall of said housing and having an outer end extending from the housing and an inner end within the chamber, at least a first circular which is disc mounted on the inner end of the shaft, and at least a second disc which is mounted in axially spaced relation to the first disc and has an opening in the center thereof, arid a conical member which extends co-axially of the shaft from the first disc toward the second disc.

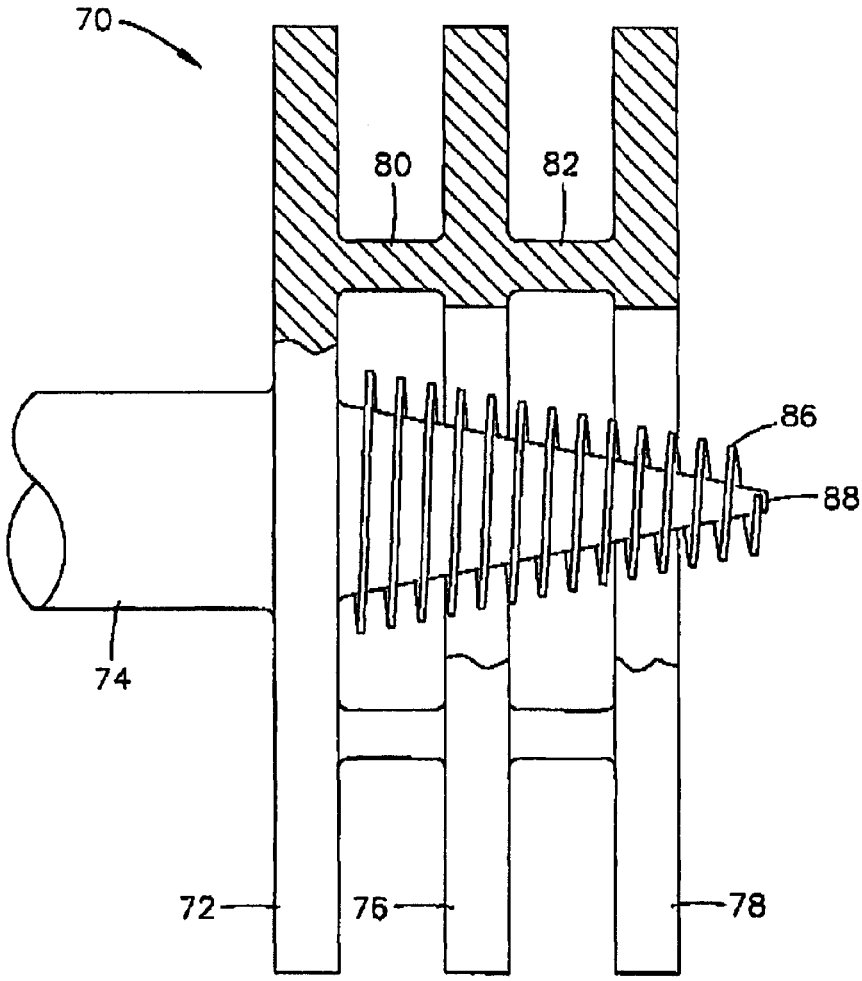

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 10 and 17 are determined to be patentable as amended.

Claims 2-9 and 11-16, dependent on an amended claim, are determined to be patentable.

1. A rotary disc pump for pumping fluid materials, comprising: a housing having a front wall, a back wall and peripheral wall joining said front and back walls forming a chamber with a generally coaxial inlet in said front wall and a generally tangential outlet formed in said peripheral wall; an impeller mounted co-axially within said chamber and comprising a shaft mounted in said back wall of said housing and having an outer end extending from said housing and an inner end within said chamber, at least a first *substantially planar* circular disc mounted on the inner end of said shaft, at least a second disc mounted in axially spaced relation to said first disc and having an opening in the center thereof; and a converging member extending co-axially of said shaft from said first disc converging toward a point at least one half the distance to said second disc; and a helical fin formed on an outer surface of said converging member.

10. A rotary disc pump for pumping fluid materials, comprising: a housing having a chamber defined by an inner and an outer side wall joined by a generally circular peripheral wall with a generally coaxial inlet in said outer wall and a generally tangential outlet formed in said circular peripheral wall: an impeller mounted co-axially within said chamber and comprising a shaft mounted in said inner wall of said housing and having an outer end extending from said housing and an inner end within said chamber, at least a first *substantially planar* circular disc mounted on the inner end of said shaft, and at least a second disc mounted to said first disc in axially spaced relation to said first disc and having a circular opening in the center thereof, and a conical member having a base at said first disc and extending co-axially of said shaft from said first disc at least half the distance to said second disc; said conical member being formed with a helical fin on an outer surface thereof.

17. A rotary disc pump for pumping fluid materials, comprising: a housing having a chamber defined by an inner and an outer side wall joined by a generally circular peripheral wall with a generally coaxial inlet in said outer wall and a generally tangential outlet formed in said circular peripheral wall: an impeller mounted co-axially within said chamber and comprising a shaft mounted in said inner wall of said housing and having an outer end extending from said housing and an inner end within said chamber, at least a first *substantially planar* circular disc mounted on the inner end of said shaft, and at least a second disc mounted to said first disc in axially spaced relation to said first disc and having a circular opening in the center thereof, a conical member having a base at said first disc and extending coaxially of said shaft from said first disc at least half the distance to said disc; said conical member being formed with a plurality of radial blades on an outer surface thereof.

* * * * *